US006588985B1

(12) United States Patent
Bernard

(10) Patent No.: US 6,588,985 B1
(45) Date of Patent: Jul. 8, 2003

(54) APPARATUS AND METHOD FOR DEPLOYING AN OBJECT OR A LOAD ON A SEABED

(76) Inventor: François Bernard, Willem de Zwijgerlaan 91, Den Haag (NL), NL-2582 EK ( * ) Notice: Subject to any disclaimer, the term of this patent is extended or adjusted under 35 U.S.C. 154(b) by 0 days.

(21) Appl. No.: 09/701,171

(22) PCT Filed: Apr. 26, 1999

(86) PCT No.: PCT/NL99/00242

§ 371 (c)(1),
(2), (4) Date: Nov. 27, 2000

(87) PCT Pub. No.: WO99/61307

PCT Pub. Date: Dec. 2, 1999

(30) Foreign Application Priority Data

May 28, 1998 (NL) ..... 1009277

(51) Int. Cl.[7] ..... B63C 11/52
(52) U.S. Cl. ..... 405/191; 405/190; 166/338
(58) Field of Search ..... 405/185, 188, 405/190, 191; 166/338, 339, 340, 341, 342, 343, 344, 345, 346–349

(56) References Cited

U.S. PATENT DOCUMENTS

| | | | | |
|---|---|---|---|---|
| 3,381,485 A | | 5/1968 | Crooks et al. | |
| 3,983,708 A | * | 10/1976 | Houot | 166/349 |
| 4,010,619 A | | 3/1977 | Hightower et al. | |
| 4,710,819 A | * | 12/1987 | Brown | 405/185 |
| 4,974,996 A | | 12/1990 | Vielmo et al. | |
| 5,069,580 A | | 12/1991 | Herwig et al. | |
| 5,158,141 A | | 10/1992 | Saliger et al. | |
| 5,190,107 A | | 3/1993 | Langner et al. | |
| 5,579,285 A | | 11/1996 | Hubert | |
| 5,793,703 A | * | 8/1998 | Shippey | 367/7 |
| 5,947,051 A | * | 9/1999 | Geiger | 114/313 |
| 6,068,427 A | * | 5/2000 | Ostergaard | 405/190 |
| 6,223,675 B1 | * | 5/2001 | Watt et al. | 405/190 |

FOREIGN PATENT DOCUMENTS

| | | |
|---|---|---|
| DE | 2 320 734 | 11/1974 |
| EP | 57-155189 | 9/1982 |
| GB | 1 291 493 | 10/1972 |
| WO | WO 97/23709 | 7/1997 |

* cited by examiner

*Primary Examiner*—Frederick L. Lagman
(74) *Attorney, Agent, or Firm*—Young & Thompson

(57) ABSTRACT

A method and an apparatus, for deploying an object or a load on the seabed, the object or the load being coupled to a hoist, such as a hoisting wire in order to enable the object or the load to be lowered to the seabed from a vessel, the apparatus including a body having parts for releasably securing the object or the load to the body and propulsion for moving the body when submerged, whereby the propulsion is positioned offset from the parts for releasably securing the object or the load, in order to be able to induce rotational control on the hoist, when the propulsion is in use.

17 Claims, 10 Drawing Sheets

48
40
46
47
44
41
49
umbilical
45
46
50
42
51
52
main module
counter-module
43

APPARATUS AND METHOD FOR DEPLOYING AN OBJECT OR A LOAD ON A SEABED

BACKGROUND OF THE INVENTION

The present invention concerns an apparatus, for deploying an object or a load on the seabed, the object or the load being coupled to hoisting means, such as a hoisting wire in order to enable the object or the load to be lowered to the seabed from a vessel, the apparatus comprising a body having means for releasably securing the object or the load to the body and propulsion means for moving the body when submerged without using guide wires.

The present invention concerns a guiding, controlling and positioning system, used during the deployment and/or recovery of loads (packages) up to ±1000 tons on the sea bed, at great depth. Structurally, the system comprises a main module and a smaller counter module joined to each other by a frame.

Due to its functions, the system's frame can be clamped directly to a load or alternatively to any hoisting means, hence securing the loads (packages) to be deployed. Equally, the system can release the said loads at any chosen time. The system also comprises propulsion- and moment control means, enabling it to control the behaviour of the load while being deployed through the entire water column.

DESCRIPTION OF THE RELATED ART

Since oil and gas at sea can also be exploited by means of floating production platforms, such exploitation of oil- and gas fields requires that several heavy objects be deployed on the seabed, moreover, these objects have to be positioned on the seabed with a relatively high accuracy.

Due to the fact that nowadays oil exploration is being conducted at greater depth, achieving the required accuracy is increasingly more difficult. To achieve such an accuracy according to traditional methods, usually a crane vessel is used. The loads are lowered to the seabed by way of auxiliary, control wires either rigged to the same vessel and/or one or more auxiliary installation supports.

Using such methods is extremely expensive. The latter have been devised in order to control turning moments in installation aids induced primarily by changing current profiles but also by non-torque balanced wire ropes. By the same token, the aim is also to guide the load towards its final heading and within its required target area.

The object of the invention therefore is to devise a system and appropriate method by which loads (packages) will be deployed, controlled and positioned accurately on the seabed in a cheaper and faster manner than the conventional installation approaches.

SUMMARY OF THE INVENTION

This object, according to the present invention, is achieved. Thereby it is possible that the apparatus is provided with first and second propulsion means secured to the body, the first and second propulsion means being positioned at opposite sides of the means for releasebly securing the object or the load.

With this measures an anti-twist device is provided. Moreover with the thrusters the position of the apparatus, and so the load, with respect to the load can be adjusted and controlled.

According to the invention it is possible that, the apparatus is provided with means to adjust the distance between the first and second propulsion means.

Also it is possible that the first propulsion means are positioned in a first-module and that the second propulsion means are positioned in a second-module.

According to the present invention and in order to eradicate these traditional costs, the system is provided with a set of four thrusters working in pairs, each having a dedicated function, namely; a torque control function and a translation function.

These thrusters are mounted on each side of the system's frame, two by two, in such a way as to achieve the above mentioned torque control by dedicating both lower thrusters to this torque control function and to achieve the translation control by dedicating both upper thrusters to this translation function.

Moreover, the second or counter module can move horizontally over a section of the frame, in order to improve torque control and to minimize stress cycles in the overall structure. It is understood that this frame comprises a hydraulically activated clamping system, ending in dedicated clamping adapters, provided with a high friction medium.

According to the invention it further possible that the propulsion means are provided in the form of thrusters.

As stated above it is possible that the first propulsion means are positioned in a first-module and that the second propulsion means are positioned in a second-module. The second-module could be attached to an arm, the length of the arm being adjustable.

According to a preferred embodiment of the invention, the first module is secured detachably to the apparatus.

According to the invention it is possible that the means for releasably securing a load comprises hydraulic jacks. Moreover the means for releasably securing a load in the apparatus could be provided with purposed designed adapters, the adapters being covered with a high friction medium.

In order to be able to achieve the required accuracy during deployments, it is preferred that the apparatus is provided with means adapted to transmit information in the direction of an object on the seabed, and with means to receive a reflection of the signal transmitted to the object, and a processor to compute the reflected information to establish the position of the apparatus with respect to the object. Also, the apparatus could be provided with a distance log.

The means for transmitting information could include sonar equipment, such as High Resolution Sonar Equipment. When the position of the load to be deployed with respect to the object on the seabed is determined, using the sonar equipment, the positioning of the load could be finalized using the distance log. So, it is possible to dissociate this final positioning activity from the surface support.

According to the present invention not only the apparatus but also a method for deploying an object or a load at the seabed is provided, the method being characterized in that the method comprises the steps of:

- moving the object or load in the direction of the seabed, by means of a first hoisting wire,
- exerting a force on the object or load, or on the first hoisting wire, approximately at the bottom end thereof by means of a second hoisting wire and
- manipulating the position of the object or the load by means of an apparatus according to one of the preceding claims, the apparatus being attached close to the object or the load. Moreover it is possible that during the deployment of the object or the load, the object or the load is lifted at least partially by means of the secondary hoisting wire.

According to the invention it is possible that during the deployment of the object or the load, the positioning of the apparatus is accomplished using a differential global positioning system (DGPS) navigation system, interfaced with a Hydroacoustic Positioning Reference (HPR) system, a Doppler device and a Fibre Optic Gyro. Moreover it is possible that the apparatus transmits information in the direction of an object on the seabed, in that the apparatus receives a reflection of the signal transmitted to the object, and the reflected information is used to establish the position of the apparatus with respect to the object, and in that the positioning of the load is accomplished by means of a distance log.

According to the present invention it is also possible that

- the first hoisting wire is paid out until the first hoisting wire is a least partially lying on the seabed,
- hoisting the object or the load and a part of the first hoisting wire by means of the secondary hoisting wire, and
- manipulating the position of the object or the load by means of the apparatus.

BRIEF DESCRIPTION OF THE DRAWINGS

Below, the invention is explained in details with reference being made to the drawings.

DESCRIPTION OF THE PREFERRED EMBODIMENTS

Figure 1:
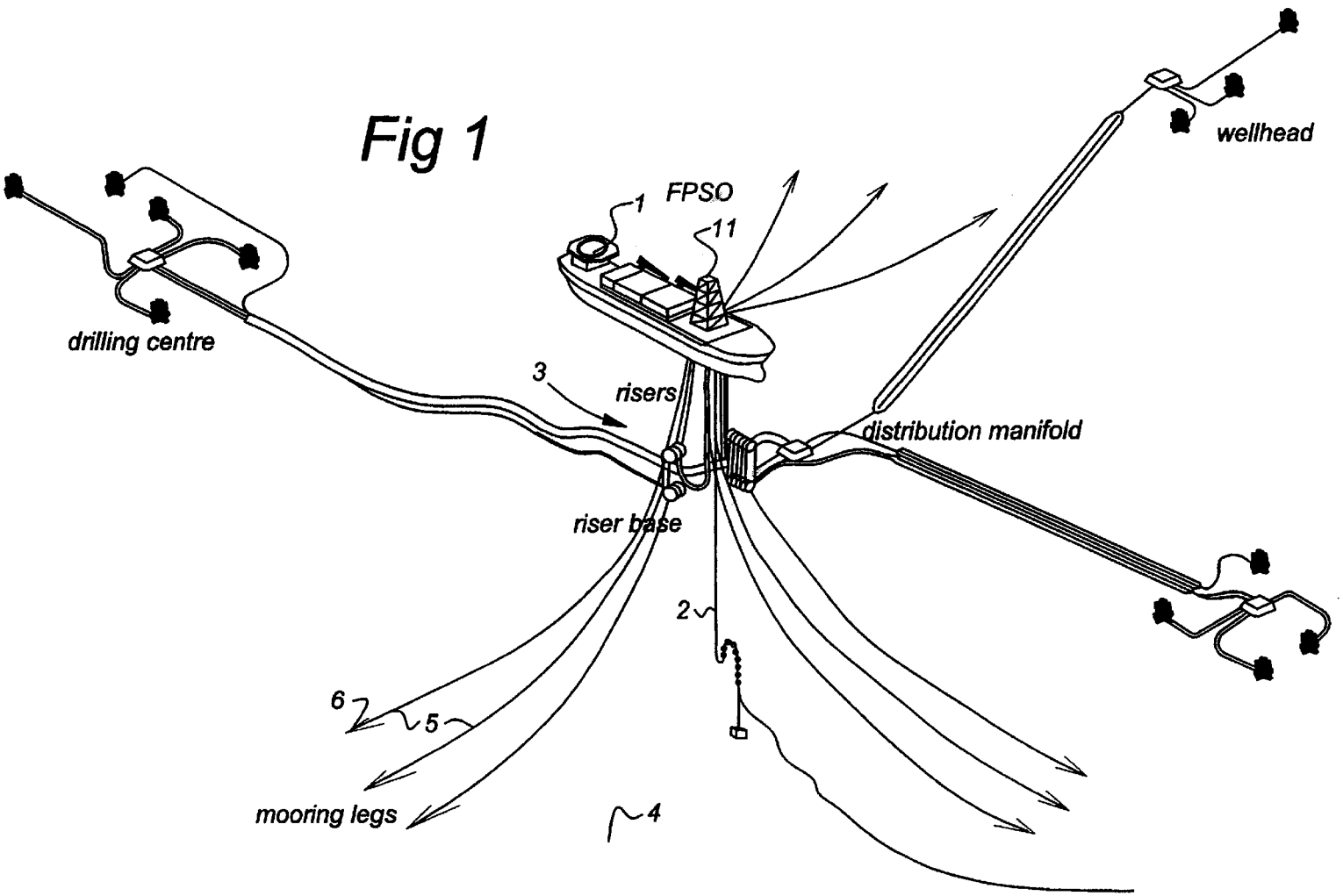
FIG. 1 shows a schematic overview of a FPSO (floating, production, storage and offloading system) dedicated to offshore petrochemical recoveries.

With FIG. 1 the layout presents a FPSO 1 with her swivel production stack 11 from which risers 2 depart, said risers connecting to their riser bases 3 at the seabed. During her production lifetime, it is tantamount for the FPSO to remain within an allowable dynamic excursion range and therefor the FPSO 1 is moored to the seabed 4 by means of mooring legs 5 which are held by anchors 6.

Exploitation of oil or gas according to FIG. 1, by means of a production vessel 1, requires that several relatively heavy objects be positioned at the seabed 4 with a relatively high accuracy.

To secure an appropriate and safe anchoring by means of the mooring legs 5, it is required that these mooring legs 5 have approximately the same length. In practice for this application anchors can be used with a weight of 50 ton and more, which are placed at the seabed 4 with an accuracy to within several meters. Moreover not only is the anchor 6 itself very heavy, but the mooring leg attached to the anchor 6 has a weight that equals several times the weight of the anchor 6 itself.

Also for other objects like the "templates", "gravity riser bases", "production manifolds" etceteras applies that these objects have to be put on the seabed 4 with relatively high accuracy.

The objects that are shown in FIG. 1 that are required for exploiting the oil and gas at sea and that have to be put on a seabed, are not only very heavy, but very expensive as well.

Figure 2:
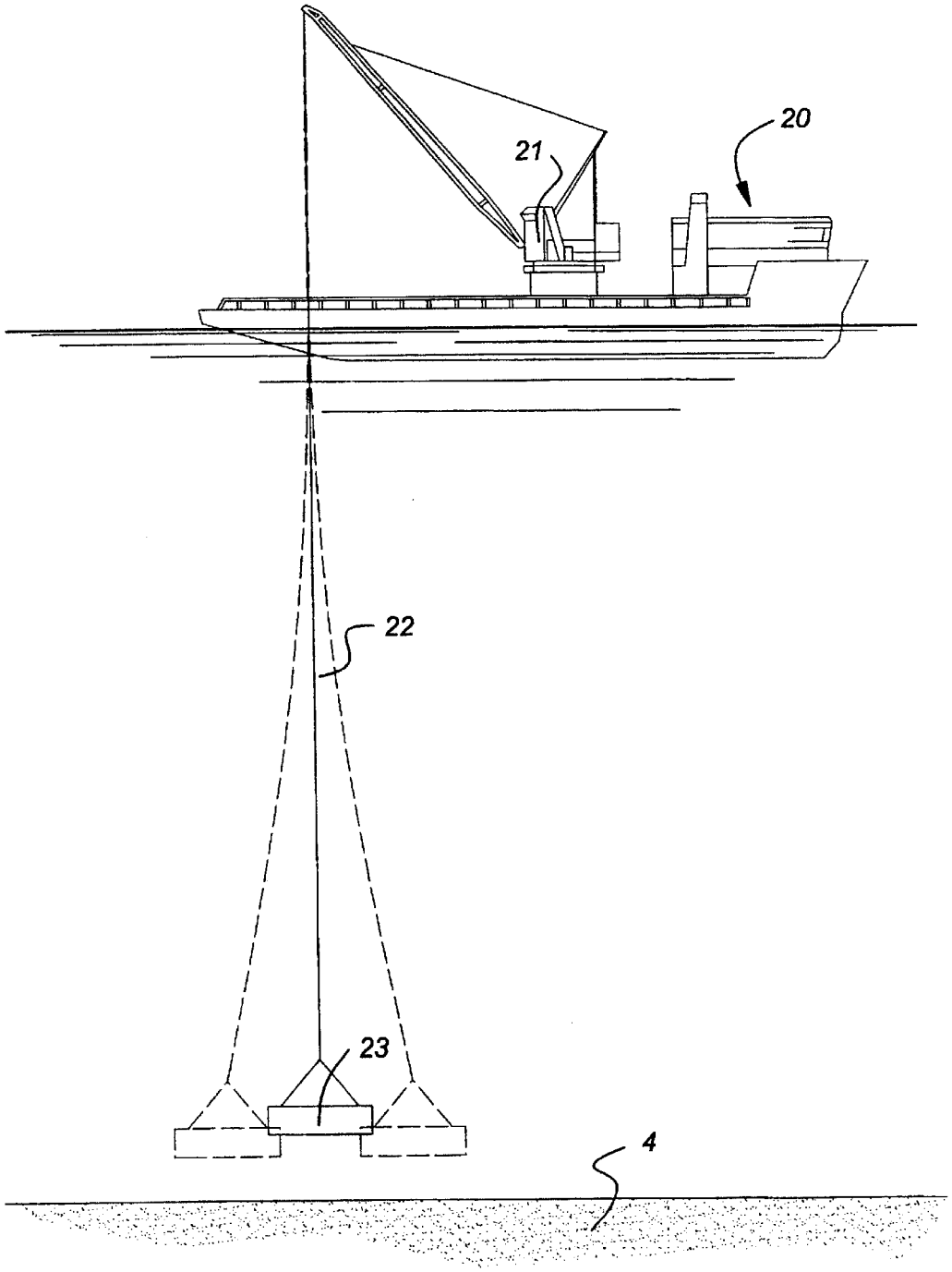
FIG. 2 shows a crane vessel according to the prior art and displaying a load rigged to the crane block with relatively long wire ropes whereby it is possible to see that the control of the load is virtually impossible at great depth.

FIG. 2 shows a vessel 20, according to the prior art, having hoisting means thereon, like a crane 21. The crane 21 is provided with a hoisting wire 22, by means whereof an object or a load 4 can be put on the seabed 5. In order to position the load 23 it is necessary to move the surface support together with the crane 21.

The result will be that, at one given time the load 23 inertia will be overcome but due to the load 23 acceleration, an uncontrollable situation will occur, whereby the target area will be overshot. Because of the fact that the hoisting wire 22 and the load 4 are susceptible to influences like the current, the load will not move straight downward, when the hoisting wire is being lowered. Also the heave of the vessel, the rolling of the vessel etc. will have a negative influence on the accuracy that can be achieved.

Figure 3:
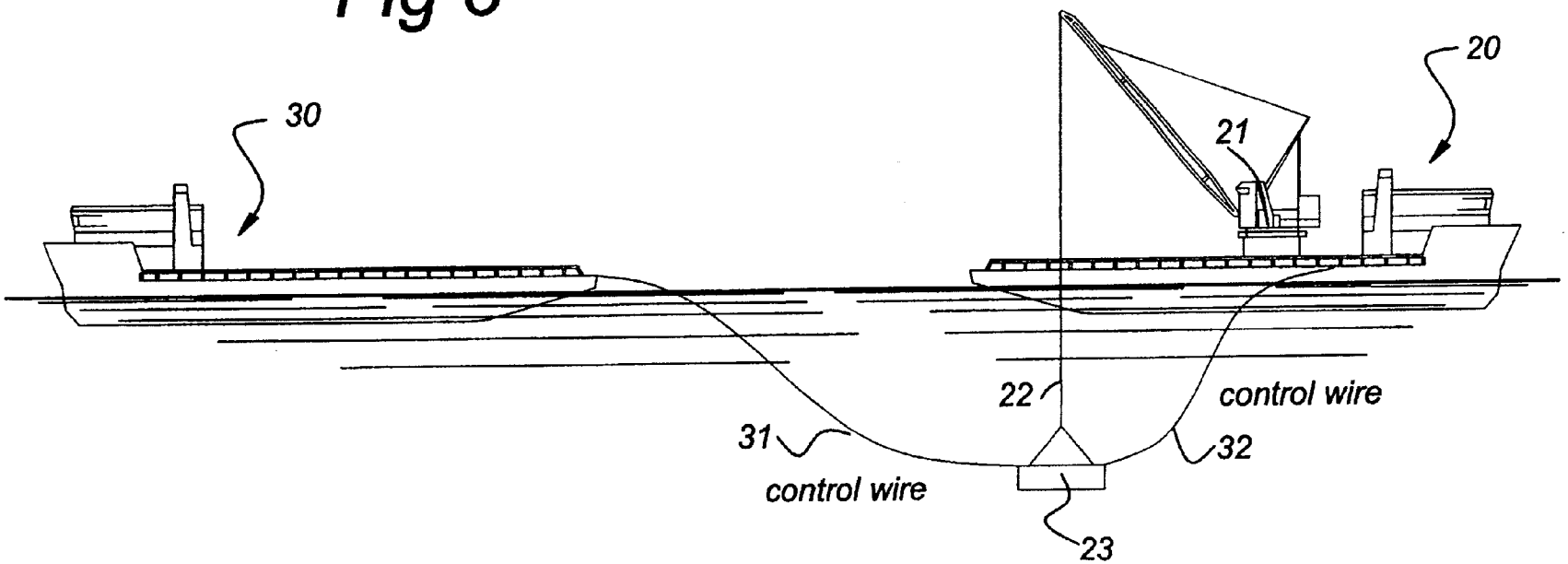
FIG. 3 shows a crane vessel according to the prior art and displaying a load rigged not only to the vessel's crane block, but also to auxiliary wire ropes on either side of the vessel as well as to a secondary surface support tow wire in order to exert a certain amount of control over the load.

In FIG. 3 a possible solution is represented according to the prior art, in order to control the position of the load 23, while lowering the hoist wire 22. Therefore the load must be secured to an auxiliary wire 31 that is controlled from an auxiliary vessel 30. Moreover the load 23 with an auxiliary wire 32 can be attached to the vessel 20.

Figure 4:
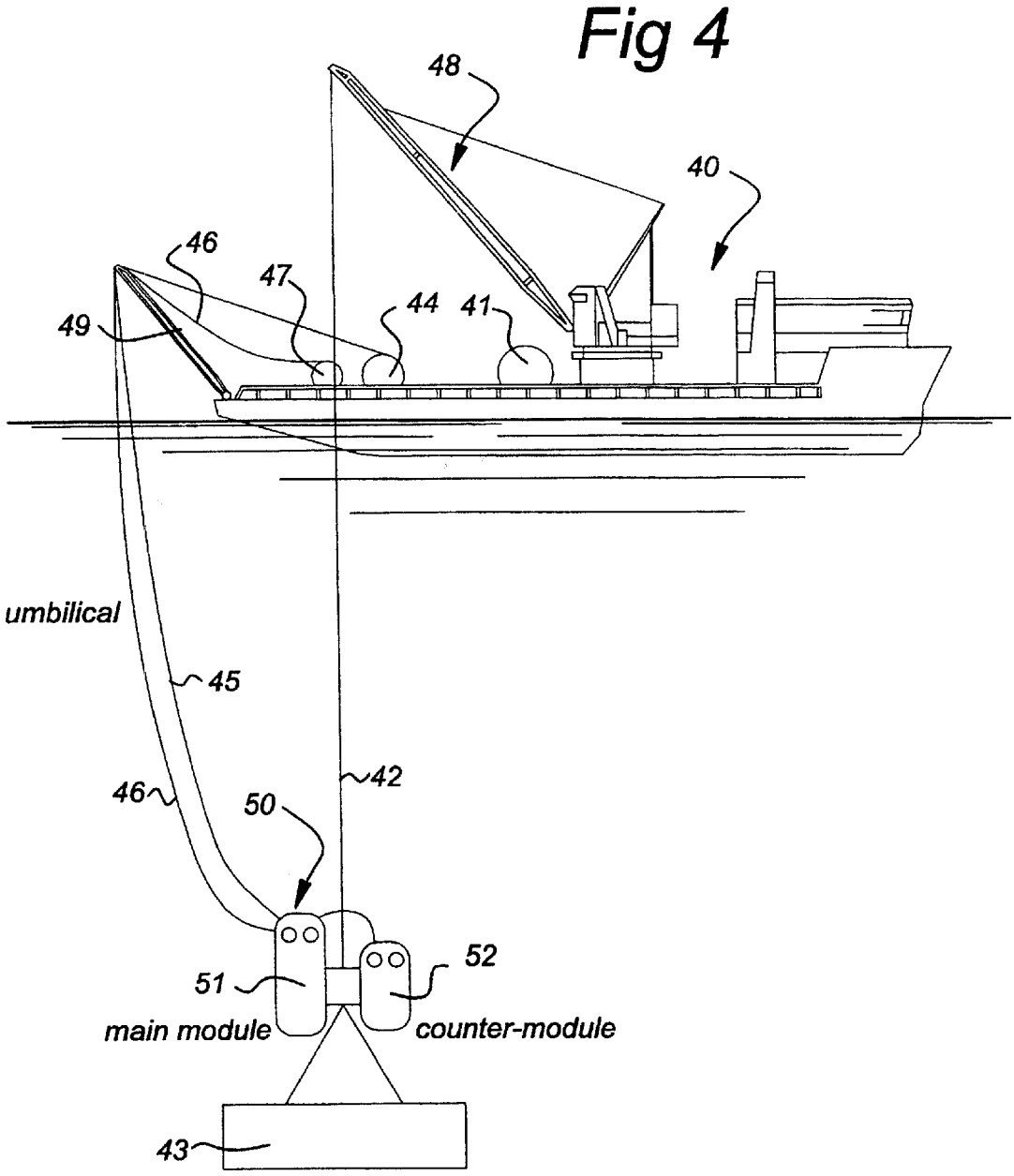
FIG. 4 shows a crane vessel and a system for deploying and/or recovering a load to and/or from the seabed according to the present invention.

FIG. 4 shows a crane vessel 40 provided with the apparatus or system for deploying a load 43 on the seabed according to the present invention, the vessel 40 comprises first hoist means, for example a winch 41, provided with a first hoist wire 42. By means of this hoist wire 42 a load 43, for instance a template can be deployed and placed at the bottom of the sea.

As mentioned above, the exploitation of oil- and gasfields using floating production platform requires that several heavy objects must be placed at the seabed, moreover, these objects have to be placed on a seabed with a relatively high accuracy. Because of the fact that nowadays the exploitation has to be done at increasing depths up to 3000 m and more, achieving the required accuracy is getting harder. One of the problems that has to be solved is the fact that the hoist wires can be twisted.

In order to control the position of the load 43 when deploying the load and in order to be able to position the load on the sea bed within the required accuracy, the apparatus or system 50 has been secured to the lifting wire 42. A preferred embodiment of the system 50 will be described with reference being made to the FIGS. 5, 6 and 7.

Figure 5:
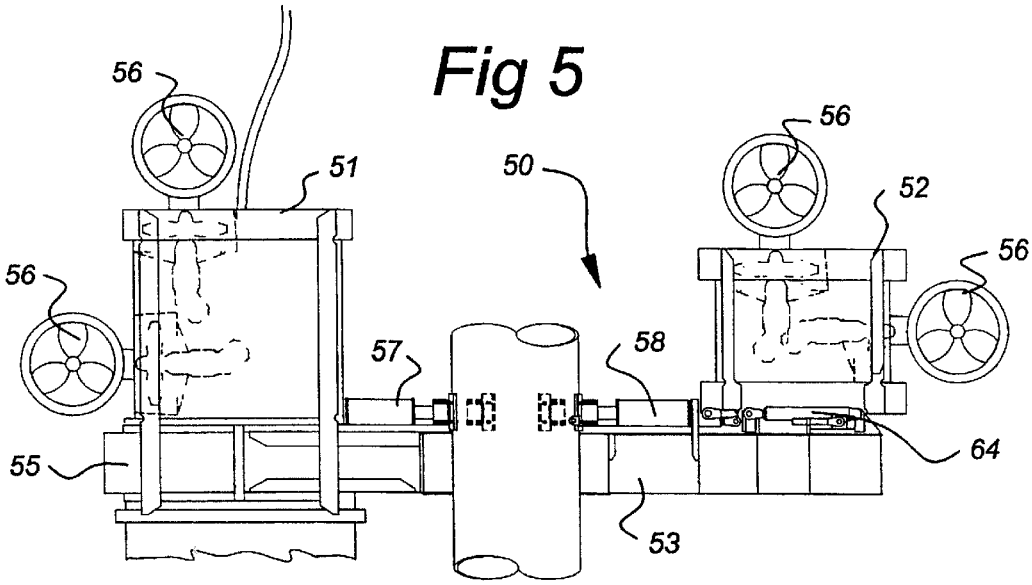
FIG. 5 shows a detail overview of a possible embodiment of the system while engaged in the activities listed in FIG. 4.
Figure 6:
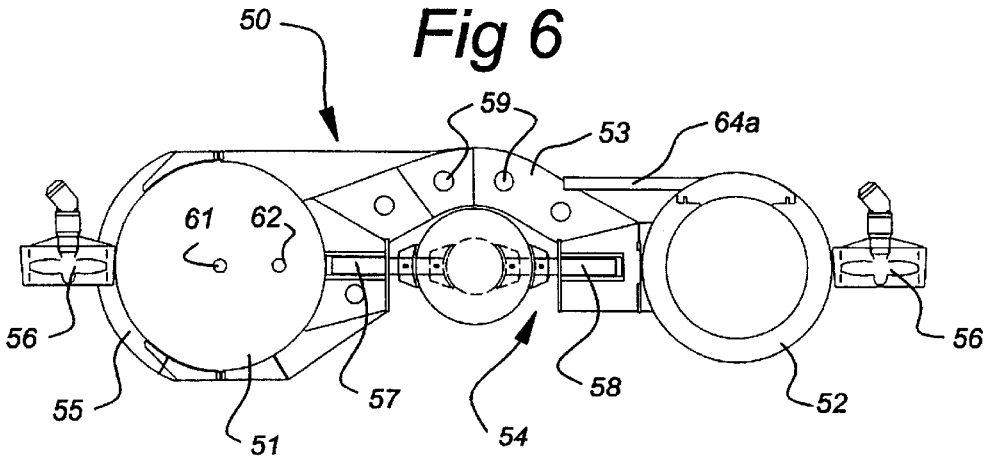
FIG. 6 shows the system viewed in accordance with FIG. 5 from above.
Figure 7:
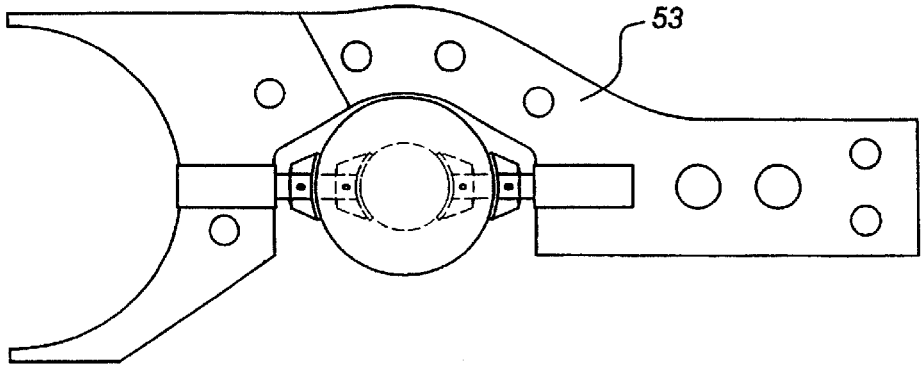
FIG. 7 shows a detail of the system (adaptation shoes for a pipe and/or crane block) according to FIG. 5.
Figure 11:
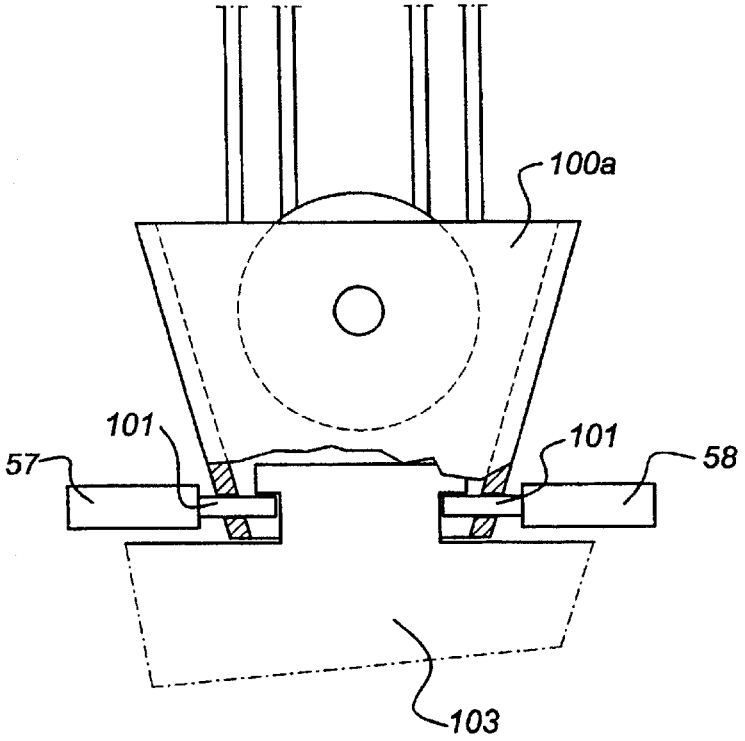
FIG. 11 shows a purpose designed crane block to be used in conjunction with the system according to the present invention.

The system 50 is fixed to the end of the lifting wire 42, for instance to the crane block 100 (FIG. 11). Also, the system 50 could be secured directly to the load 43 itself. The system 50 comprises a first or main-module 51, provided with drive means such as thrusters (FIGS. 5 and 6). The system further comprises of a second or counter module 52. This counter-module 52 also is provided with thrusters. In use the thrusters of the main-module 51 and of the counter-module 52 will be positioned at opposite sides of the lifting wire 42. The system is coupled with the vessel 40 by means of a second lifting wire 45, which can be operated using second hoist means, for instance a second winch 44. The second hoist wire 45 for instance is set overboard by means of an A-frame 49. The second winch 44 and the secondary hoist wire 45 normally will be lighter than the first hoist means 48 and the primary hoist wire 42, respectively. The system further is connected to the vessel 40 by means of an umbilical 46. This umbilical can be attached to the hoist wire 45 or can be lowered from the tertiary winch 47 separately. The electricity wiring for providing power to the system 50 is for instance accommodated in the umbilical. In the system 50 usually means are provided to convert the electrical power into hydraulic power. The hydraulic power consequently will be used for controlling i.a. the thrusters and auxiliary tooling amenities.

The invention avoids the need to use guide wires in positioning and controlling turning of the load by using a set of thrusters linked to a sensor, as disclosed below.

Since lately the work is being done at an increasing depths, the twisting and turning of the long hoist wires 42 is becoming a bigger problem still. Since heavy loads 43 are attached at the underside of the hoist wire 42, that twisting can impel a relatively large wear on the hoist wires, so severe damage can occur at the hoist wires. This wear can be so severe that a hoist wire 42 will break and the load 43 will be lost. Another problem is that because of the enormous twists in the wires, the wires at the vessel can run out of the sheaves. Because of the fact that the thrusters of the main-module 51 and of the counter-module 52, respectively, are positioned at opposite sides of the lifting wire 42, a counter-torque can be exerted at the hoist wire 42 in both directions. In this way by means of the system an anti-twist device is formed. In order to improve the abilities of this anti-twist device, preferably, the distance between the main-module 51 and the counter-module 52 can be altered.

FIG. 5 shows a detailed overview of a possible embodiment of the system 50 for deploying a load on the seabed according to the present invention. FIG. 6 shows the system according to FIG. 5, from above.

The system 50 comprises a main-module 51, a counter-module 52 and an arm 53. The arm can be detached from the main-module 51. That means that the main-module 51 can also be used separately (see FIGS. 9 and 10), as a modular system.

The arm 53 is provided with a recess 54. On opposite sides of this recess 54 two jacks 57, 58 are provided, at least one of which can be moved relative to the other. In between the end surfaces of these jacks 57, 58 an object, such as a crane-block 100, can be clamped. In order to improve the contact between the jacks 57, 58 and the object, the respective ends of the jacks are accomodated with clamping shoes lined with a friction element 60, from a high friction material such as dedicated rubber.

As shown in FIG. 5, the system 50 is provided with thrusters 56. In use those thrusters 56 can be used to position the system relative to the target area. The thrusters 56 can be actuated from a first position mainly inside the system 50, to a position in which the thrusters projects out of the system 50.

In FIG. 6 it is shown that there are two positions 61, 62 on top of the main-module 51 to connect the main module to the second lifting wire 45 and/or to the umbilical 46. When the main-module 51 is used separately (FIGS. 9 and 10) position 61 can be used. The main-module 61 will be balanced when the module 61 is deployed, both in the air and underwater.

When the system 50 is used, the connection between the vessel 40 and the system 50 will be fixed in position 62 in order to keep the system in balance, both in the air and underwater. To improve the balance of the system, an auxiliary counterweight 55 can be secured to the system 50.

In use the apparatus 50 will not have any buoyancy. In order to improve the movability of the system under water, the arm 53 is provided with holes 59, in order to avoid structural damage due to an increasing pressure while being lowered and to ensure quick drainage during the recovery phase.

As mentioned above, it is advantageous when the counter-module 52 can be moved relative to the main-module 51. This can be accomplished by using jacks 64*a*. The mounting of the counter-module 52 on the arm 53 is shown in detail in FIG. 7.

The operation of the system 50 according to the invention is as follows:

When deploying a load 43 from a vessel 40 to the seabed, the load will be deployed using a hoist wire 42. In order to control the position of the load while deploying, the system 50 according to the invention will be secured to the crane block 100, near the bottom end thereof. The thrusters 56, in the system 50 are remotely operated from the vessel 40. The system 50 is provided with sensor means, in order to be able to communicate with the vessel 40. When the load 43 is not moving in the right direction, the position of the load can be adjusted by activating the thrusters 56 in the system 50 in an automated manner. With reference to the invention, positioning is achieved by interfacing several surface and acoustic reference systems via a proprietary software design which involves as a minimum the following combinations while deploying the loads:

DGPS (Differential Global Positioning System)

SSBL-HiPaP (Super Short Base Line)

Doppler Effect and North seeking gyro.

Furthermore with reference to the invention, once the load has reached its intended depth, the positioning thereof it will be finalized by using a High Resolution Sonar Equipment interfaced to a distance log device and at least one fixed object, whereby it will then be possible to dissociate the positioning activities from the surface support, as well as from any other acoustic transponder devices such as LBL (Long Base Line) arrays while accuracy in the order of centimeters will be achieved within a large radius.

It will be appreciated that the apparatus according to the invention operates free of guidelines.

Figure 8B:
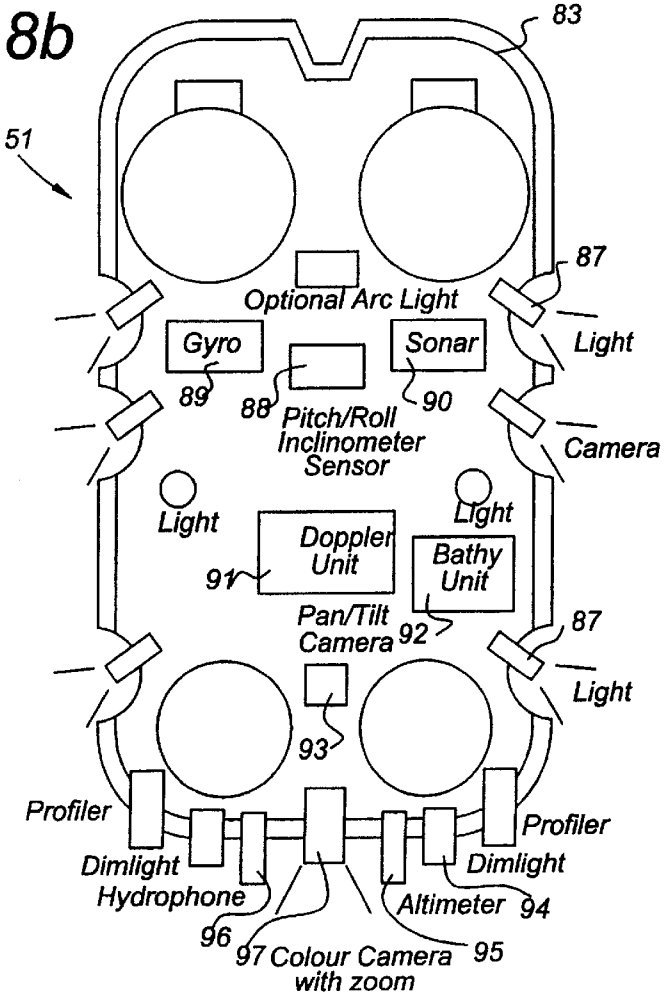
FIGS. 8*a*, 8*b* show a cross-sectional view of the main module of the system hardware equipment required in order to conduct deploying and/or recovering activities according to the present invention.
Figure 8A:
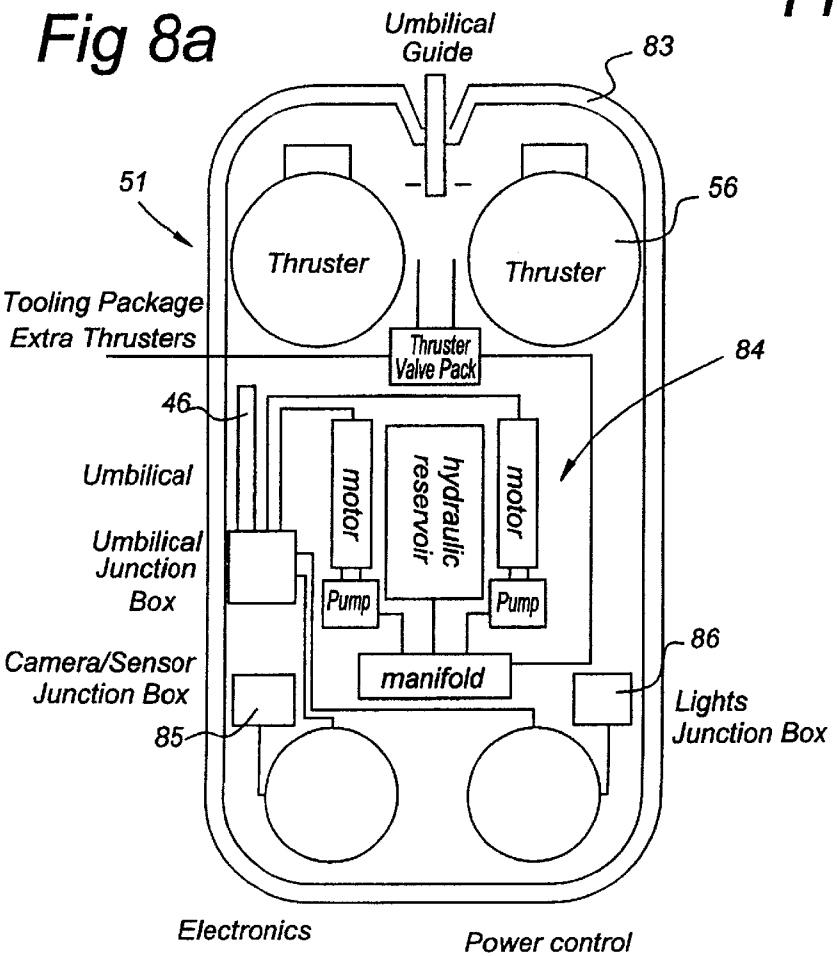

In FIG. 8 a possible construction for the main-module 51 is shown. The module 51 comprises an outer frame 83 and an inner frame (not shown). The inner frame preferably is cylinder-shaped. By connecting the outer frame 83 to the inner frame, a very strong construction can be accomplished. The strength of the construction is necessary in order to avoid premature fatigue in the system.

The module 51 for instance is partly made of high-tensile steel and thereby designed to be used as integral part of the first 42 or second hoist wire 45. This means that the top side of the module 51 will be connected to a first part of the hoist wire 45, and that the underside of the module 51 will be connected to a second part of the hoist wire 45, or the underside of the module 51 will be attached directly to the load. In this way the load on the hoist wire will be transferred through the module 51.

As mentioned before, the module 51 is provided with means 84 for converting electrical power, delivered through the umbilical 46, into hydraulic power. These converting means 84 comprising a motor, a pump, a manifold and a hydraulic reservoir. In order to communicate with an operator on a vessel, the module 51 further comprises sensor means and control means. The module 51 is equipped with a camera/sensor junction box 85 and a light junction box 86. Furthermore the module 51 comprises light-sources 87, a Pitch/Roll inclinometer sensor 88, a gyro 89 and sonar equipment 90.

The module 51 also accommodates a Doppler 91 unit, a Bathy unit 92 and a Pan/Tilt camera 93. At the underside of the module are fixed a dimlight-unit 94, an altimeter 95, a hydrophone 96 and a colour camera with zoom 97.

As mentioned above the use of the High Resolution Sonar Equipment together with a distance log is important to achieve the required accuracy, once the load has reached its intended depth. The Sonar Equipment will be used to determine the position with respect to at least one object positioned at the seabed. Using the distance log, it will then be possible to dissociate the positioning activities from the surface support, as well as from any other acoustic transponder devices such as LBL (Long Base Line) arrays, while accuracy in the order of centimeters will be achieved within a large radius.

By means of the module 51 the position of the load can be manipulated. Since the weight of the anchor chain 42, will be lifted by the first hoist means 41 and only a relatively small weight will be carried by the secondary hoist wire 45, the freedom of movement of the module 1 is relatively high. That means, that despite the enormous weight of both the anchor chain 42 and the load 43, the load 43 can be placed with a relatively high accuracy at its destination.

With reference to drawings 9 and 10 it is understood that the system can either be used from a crane vessel or from an Anchor Handler Tug whereby in the case of an AHT support, the primary hoisting wire will be used to lower the load 42 to the seabed while the purpose of the secondary wire 45 will be to pick up some of the loads through the system hence creating a "belly" in the primary wire and providing an excursion radius in order to position the load at its intended location, solely using the thrust capacity of the system.

The combination of the secondary hoist wire 45 and a module 51 allows that jobs, such as positioning an anchor 43, can be executed with a high accuracy, by means of much smaller vessels than presently are being used in the prior art.

Figure 9:
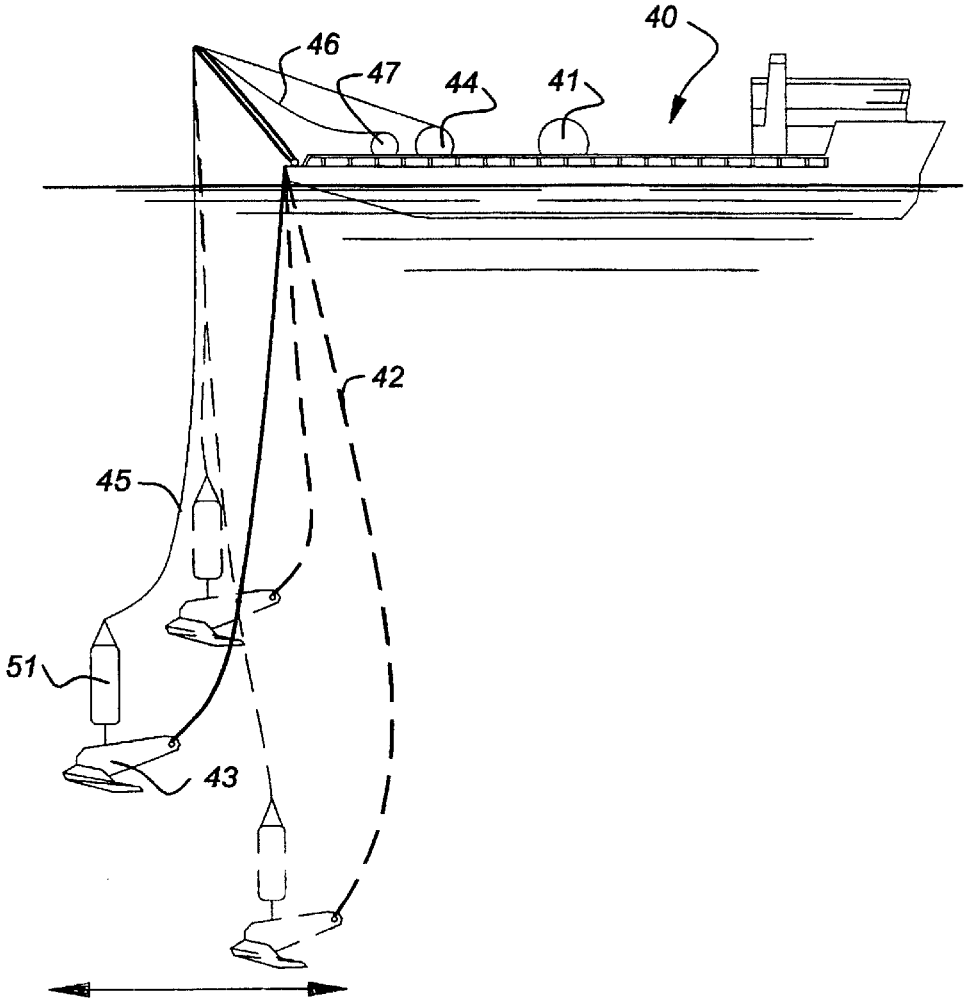
FIGS. 9 & 10 show a possible use of the main module of the system as stand-alone equipment during the deployment of an anchor and anchor chain according to the present invention.

In FIG. 9 an anchor 43 is shown provided with an anchor chain 42. An anchor chain known in the prior art, for instance, has a specific weight of 250 kg per meter. When such a chain is being lowered 2000 meter, the overall weight of the chain is no less than 500 ton. When at the end of the anchor chain an anchor will be attached with a weight of for instance 75-ton, the weight of the anchor itself is only a small part of the overall weight of the sum of the anchor and the chain.

Figure 10:
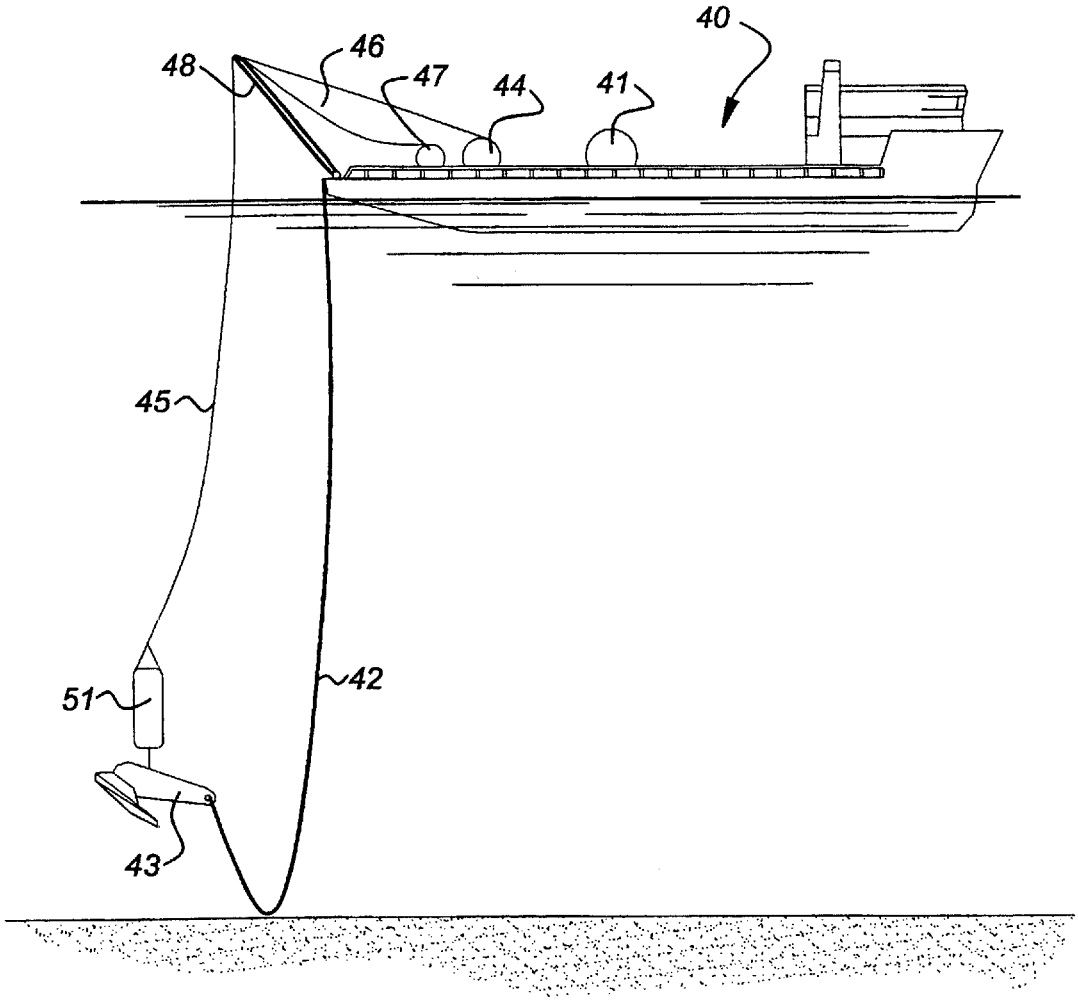

In FIG. 10 the advantages of using the module 51 by itself are shown even more clearly, for instance in case that an anchor 43 is placed at the seabed. In the surroundings of the destination so much anchor chain 42 is being lowered, that the anchor chain 42 rests upon the seabed. Consequently the anchor 42 will be lifted with a relatively small length of anchor chain. By means of the module 51 the anchor can be moved then to the required destination. The length of the anchor chain from the anchor to the seabed 4 thereby determines the radius of action in which the anchor 43 can be positioned.

In FIG. 11 an embodiment of a crane block 100 is shown, that could be used with the system 50 according to the invention.

Because of the fact that the system 50 enables accurate positioning of both the crane block 100 and a load 43, it is possible to also recover objects from the sea bed with the system. Above the presence of the jacks 57 and 58 is explained. Those jacks 57 and 58 with an alternative crane block 100 could be used to deploy and recover object. The crane block 100 is provided with through holes 101, at opposite sides of the block 100. When the crane block is positioned in the recess 54 in the apparatus 50, the jacks 57 and 58 can be displaced through the holes 101. When an object, for example a template 103, is provided with a T-shaped projection, the object can be released and recovered by moving the jacks 57, 58 through the holes 101.

Figure 12:
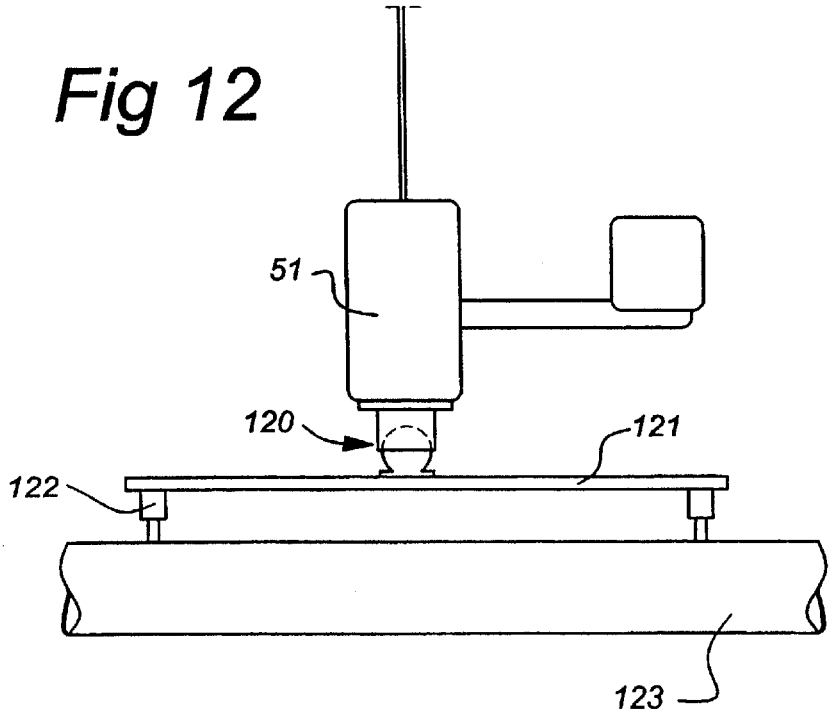
FIG. 12 shows an embodiment of the system's main module being used for deployment and installation of a spool piece diver-less at great depth according to the present invention.
Figure 13:
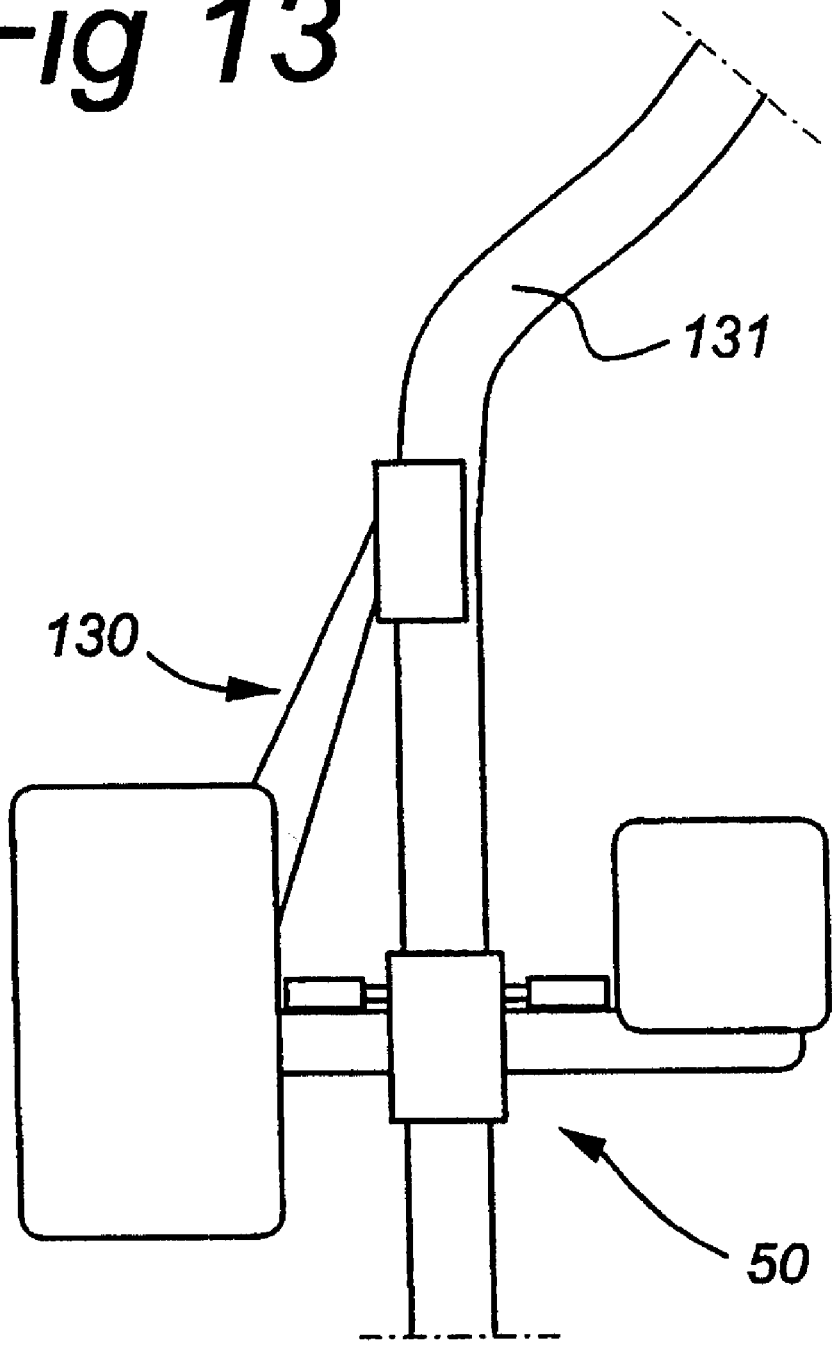
FIG. 13 shows the embodiment of the system's main module being used for deploying and docking rigid and/or flexible risers to a riser base in a diver-less mode at great depth.

In FIG. 12 an embodiment of the module 51 is shown, adapted to be used when deploying a spool piece. The module 51 is provided with a ball-shaped hydraulic rotator 120, connected to a hydraulic base frame equipped with jacks 122. By operating the jacks 122, any position on all planes of the spool piece 123 can be accomplished.

The system 50 according to the invention also could be used for connecting a flexible, riser 131 to a riser base. In order to avoid undue stress in the material of the flexible riser, the system could be provided with a support arm 130, to provide the lower part of the flexible riser with sufficient rigidity in order to be connected to the riser base.

An advantage of the system 50 and the method according to the present invention is that a reduction of the risks associated with placing the heavy objects is accomplished.

A further important advantage is that the preliminary-design and fabrication of several required parts for the objects can be executed more accurately. The reason therefore being that there is more certainty about the accuracy that will be achieved, during positioning of the objects on the seabed.

In the description above, several times it is mentioned that the present invention relates to positioning of heavy objects on the seabed. It has to be understood that the invention can be used advantageously as well for hoisting or lifting the objects from the seabed.

What is claimed is:

1. Apparatus (50) for deploying a load (43) on the seabed (4), the load (43) being coupled to hoisting means, such as a hoisting wire (42), in order to enable the object or the load (43) to be lowered to the seabed from a vessel (40), the apparatus (50) comprising a body (53) having means (57, 58) for releasably securing the load (43) to the body (53) and propulsion means (56) for moving the body when submerged, the propulsion means including a first set of thrusters, positioned offset from the means (57, 58) for releasably securing the load (43), wherein said apparatus is provided with a sensor (89) to provide data regarding the orientation of the apparatus and allow to drive said thrusters of said first set of thrusters to provide torque control in order to prevent turning of the load (43) without using guide wires, wherein said first set of thruster comprises a first thruster and a second thruster positioned at opposites sides of the means (57, 58) for releasably securing the object or the load (43), the apparatus being provided with means to adjust the distance between the first and second thrusters in order to improve torque control and to minimize stress cycles in the overall structure.

2. Apparatus according to claim 1, wherein said sensor is a north seeking gyro (89).

3. Apparatus according to claim 1, wherein the propulsion means (56) comprise a second set of thrusters to provide translation control to said apparatus while said first set of thrusters provides said torque control.

4. Apparatus according to claim 1, wherein the first thruster module (51) and the second thruster is positioned in a second module (52).

5. Apparatus according to claim 4, wherein the first module (51) is secured detachably to the apparatus.

6. Apparatus according to claim 1, wherein the means for releasably securing the load comprise hydraulic jacks (57, 58).

7. Apparatus according to claim 1, wherein the means for releasably securing the load in the apparatus are provided with purpose designed adapters.

8. Apparatus according to claim 7, wherein the adapters are covered with a high friction medium.

9. Apparatus (50) for deploying a load (43) on the seabed (4), the load (43) being coupled to hoisting means, such as a hoisting wire (42), in order to enable the object or the load (43) to be lowered to the seabed from a vessel (40), the apparatus (50) comprising a body (53) having means (57, 58) for releasably securing the load (43) to the body (53) and propulsion means (56) for moving the body when submerged, the propulsion means including a first set of thrusters, positioned offset from the means (57, 58) for releasably securing the load (43), wherein said apparatus is provided with a sensor (89) to provide data regarding the orientation of the apparatus and allow to drive said thrusters of said first set of thrusters to provide torque control in order to prevent turning of the load (43) without using guide wires, wherein the thrusters can be actuated from a first position mainly within the apparatus to a position in which the thrusters project out of the apparatus.

10. Apparatus according to claim 1, wherein the apparatus is provided with means to transmit information in the direction of an object on the seabed (4), and with means to receive a reflection of the signal transmitted to the object, and a processor to process the reflection to establish the position of the apparatus with respect to the object.

11. Apparatus according to claim 10, wherein the apparatus is provided with high resolution sonar equipment interfaced to a distance log.

12. A method for deploying a load at the seabed from a vessel using the apparatus of claim 1, comprising the steps of:

attaching the apparatus to a load (43) which is attached to a first hoist wire (42);

moving the load (43) towards the seabed (4) by means of said first hoist wire (42);

exerting a counter-torque to said first hoist wire (42) in order to counteract twisting and turning of the first hoist wire during lowering of the load (43) to the seabed (4).

13. Use according to claim 12, wherein during deployment of the load (43), the load (43) is lifted at least partially by means of a second hoist wire (45).

14. Use according to claim 12, wherein, during deployment of the load (43), the positioning of the apparatus is accomplished using a differential global positioning system (DGPS) navigation system interfaced with a Hydroacoustic Positioning Reference (HPR) system, a Doppler device and a Fibre Optic Gyro.

15. Use according to claim 12, comprising the following steps:

paying out the first hoist wire (42) until the first hoist wire (42) is at least partially lying on the seabed;

hoisting the load (43) and a part of the first hoist wire (42) by means of the second hoist wire (45), and manipulating the position of the load (43) by means of said apparatus.

16. System comprising an apparatus according to claim 1 and a vessel (40), the vessel (40) being arranged to remotely operate said apparatus (50).

17. Apparatus for deploying a load on the seabed, the load being coupled to a hoist in order to enable the load to be lowered to the seabed from a vessel, the apparatus comprising:

a body having means for releasably securing the load to the body and propulsion means for moving the body when submerged, the propulsion means including a first set of thrusters, positioned offset from the means for releasably securing the load;

a sensor to provide data regarding the orientation of the apparatus and allow to drive said first set of thrusters to provide torque control in order to prevent turning of the load without using guide wires, said first set of thrusters comprising a first thruster and a second thruster positioned at opposite sides of the means for releasably securing the object or the load; and means to adjust the distance between the first and second thrusters in order to improve torque control and to minimize stress cycles in the overall structure.

* * * * *